US009517170B1

(12) United States Patent
Sawatzky

(10) Patent No.: US 9,517,170 B1
(45) Date of Patent: Dec. 13, 2016

(54) RESCUE BASKET

(71) Applicant: Randal G. Sawatzky, Kelowna (CA)

(72) Inventor: Randal G. Sawatzky, Kelowna (CA)

( * ) Notice: Subject to any disclaimer, the term of this patent is extended or adjusted under 35 U.S.C. 154(b) by 0 days.

(21) Appl. No.: 14/998,413

(22) Filed: Jan. 4, 2016

(51) Int. Cl.
*A61G 1/003* (2006.01)
*A61G 1/013* (2006.01)
*A61G 1/04* (2006.01)

(52) U.S. Cl.
CPC ..... *A61G 1/013* (2013.01); *A61G 1/003* (2013.01); *A61G 1/04* (2013.01)

(58) Field of Classification Search
CPC ..... A61G 1/00; A61G 1/003; A61G 1/013; A61G 1/04; A61G 1/044; A61G 1/048
USPC ..... 5/625, 627, 628, 626
See application file for complete search history.

(56) References Cited

U.S. PATENT DOCUMENTS 2,328,047 A * 8/1943 Anderson et al. ..... A61G 1/017 280/47.25
3,414,914 A * 12/1968 Gramins ..... A47C 17/66 5/625
3,574,871 A * 4/1971 Greene ..... A61G 1/003 5/627
3,597,773 A * 8/1971 Firestone ..... A61G 1/003 248/354.3
3,653,079 A * 4/1972 Bourgraf ..... A61G 1/003 24/611
3,801,208 A * 4/1974 Bourgraf ..... A61G 1/003 403/102
3,813,712 A * 6/1974 Bonnin ..... A47C 23/14 5/110
5,803,087 A * 9/1998 Thompson ..... A61G 1/003 128/870
6,561,724 B1 * 5/2003 Carletti ..... F16B 7/22 403/315
6,722,812 B1 * 4/2004 Carletti ..... A61G 1/003 403/322.4
6,725,480 B2 4/2004 Sawatzky
6,859,963 B2 3/2005 Sawatzky
(Continued)

*Primary Examiner* — Robert G Santos

(57) ABSTRACT

A rescue basket apparatus having at least one top rail extending longitudinally around the upper edge of the rescue basket defining an opening into the basket cavity, the rescue basket having a head end and a foot end, and at least two transverse crossbars affixed to the at least one top rail so as to extend down a first side, across a bottom and extending up a second side and affixed to the at least one top rail of the rescue basket. There are at least two bottom runner rails running longitudinally along the rescue basket bottom. There are two pairs of bridle attachment members spaced longitudinally apart relative to the top rail, each bridle attachment member has a bridle attachment receiving opening and the bridle attachment members are pivotally mounted to the transverse crossbars near and below the top rail. The bridle attachment members receiving opening extends inwardly into the rescue basket cavity. The bridle attachment members' pivotal movement is confined to a partial rotation about the transverse crossbars. The rescue basket may be a single piece design, or a two piece split-apart type. The two piece split-apart rescue basket has locking connectors that make the basket easy to assemble and very ridged when connected into one piece. These connectors include a secondary safety latch that prevent any undesired disconnection.

13 Claims, 9 Drawing Sheets

(56) References Cited

U.S. PATENT DOCUMENTS

| | | | | |
|---|---|---|---|---|
| 7,155,764 | B2 | 1/2007 | Sawatzky | |
| 7,216,386 | B2 | 5/2007 | Sawatzky | |
| 7,810,190 | B1 | 10/2010 | Antonio | |
| 7,926,132 | B2 | 4/2011 | Jordan | |
| 8,763,179 | B2 * | 7/2014 | Roysum | A61G 1/013 5/625 |
| 2003/0150059 | A1 * | 8/2003 | Sawatzky | A61G 1/04 5/626 |
| 2004/0172759 | A1 * | 9/2004 | Sawatzky | A61G 1/04 5/626 |
| 2005/0044632 | A1 * | 3/2005 | Sawatzky | A61G 1/04 5/626 |
| 2005/0177943 | A1 * | 8/2005 | Sawatzky | A61G 1/013 5/627 |
| 2008/0178383 | A1 * | 7/2008 | Jordan | A61G 1/00 5/89.1 |
| 2013/0263376 | A1 * | 10/2013 | Roysum | A61G 1/013 5/628 |

* cited by examiner

RESCUE BASKET

FIELD OF THE INVENTION

The invention relates to a rescue basket generally used to rescue injured patients by rope.

BACKGROUND OF THE INVENTION

Rescue baskets, often referred to as litter baskets within the industry, as utilized by emergency personnel, of which a general style is well known. Rescue baskets are generally comprised of a sturdy, light-weight, open frame manufactured from stainless steel tubing or like material, including both longitudinal and transverse components which are secured by welding or the like into an integral unit. They generally have a sturdy peripheral top rail of 1-inch diameter, which surrounds the basket stretcher opening and one or more intermediate rails of ½ inch diameter material, spaced from and generally parallel to the top rail. Transverse components, or ribs, are secured by welding to the underside of top rail. The sturdy peripheral top rail surrounding the basket stretcher opening, lends rigidity and strength to the stretcher and also provides a convenient hand-hold for emergency personnel when transporting an injured patient.

Generally the top rail is the most convenient attachment point for a tether such as ropes or webbing or the like, which enable emergency personnel to either raise or lower the basket rescue stretcher adjacent to say a building or an escarpment. A lifting bridle harness or so-called litter bridle or bridle sling arrangement, which may include four equal lengths, or four adjustable lengths, or two equal and two adjustable length ropes or webbing belts that are connected to a single lifting ring. Such tethers or four point lifting bridles are commonly secured to the top rail by screwgate carabiners or other such secure shackles and clipped over the peripheral top rail.

Accordingly, it is an object of the present invention to provide a more flexible bridle attachment members that adapt more to lifting the rescue basket in multiple directions with better balance and less twisting and side impact of the lifting bridle carabiners, or other similar shackle types.

SUMMARY OF THE INVENTION

The stretcher of the present invention has rotatable bridle attachment brackets which are inwardly disposed into the stretcher basket top sides and located near the head and foot ends of the stretcher, and located equidistant from a theoretical loaded balance point of the stretcher. The rotatable attachment brackets permit the stretcher to be raised or lowered adjacent to a vertical or inclined surface, such as the outside of a building or an escarpment, in a manner which is relatively balanced and stable.

The attachment brackets according to the present invention may be, as an example, machined from stainless steel billet, or other appropriate material and mounted as part of the manufacture of new rescue basket.

The present invention can be defined as a rescue basket with at least one top rail extending longitudinally around the upper edges of the top of the rescue basket which defines an opening into the basket cavity. The rescue basket includes a head end and a foot end with at least two transverse crossbars usually welded onto the bottom surface of the top rail. The crossbars are spaced so that they are in the area of best balance, one crossing the head basket area and one crossing the foot basket area. The crossbars extending down from the top rail on one side, across the bottom and then extending up the other side and again welded to the top rail. Extending longitudinally along the bottom there are generally two bottom runners that are attached by welding the bottom runners to two transverse crossbars.

The two transverse crossbars each have a pair of rotatable bridle attachment members attached directly to the transverse cross bars, one on each side just below the top rail. The rotatable bridle attachment members are mounted to the transverse crossbars during the manufacturing process, so as to use the crossbars as the axis, or center of rotation of the rotatable bridle attachment members. Each of the bridle attachment members has a receiving opening that extends inwardly into the rescue basket cavity. The bridle attachment members each have a restricted pivotal movement that is confined to a partial rotation about an axis on the transverse crossbars. Depending on the rescue baskets application it is preferable that the rotation of the bridle attachment members at the head end of the rescue basket be restricted to between a maximum of 180 degrees and a minimum of 160 degrees of rotation, and the rotation of the bridle attachment members at the foot end of the rescue basket are confined to between 90 and 10 degrees.

In some applications it is preferable that the pivotally mounted bridle attachment members include O-rings to seal the rotation bushings, as well as offing a stiffer rotational movement which would keep the members steady when being hooked up to the bridle harness.

In a further aspect of the present invention the rescue basket includes a split-apart system where the top rail is connected together between the head and the foot end by a pair of lever operable male and female quick couplers or latches, and a pair of male and female hinged connectors on the runner rails. These quick coupling connectors allow the rescue basket to be easily separable for storage and transport, and then the two connectable sections can then be easily assembled into a rigid and sturdy rescue basket ready for use. The lever latch connectors on the top rail include a secondary safety lock that protects the lever latch from being inadvertently released.

BRIEF DESCRIPTION OF THE DRAWINGS

Advantages of the present invention will become more fully appreciated as the same becomes better understood when considered in conjunction with the following detailed description and accompanying drawings, in which like reference characters designate the same or similar parts throughout the views, wherein.

DESCRIPTION OF THE INVENTION

Figure 1:
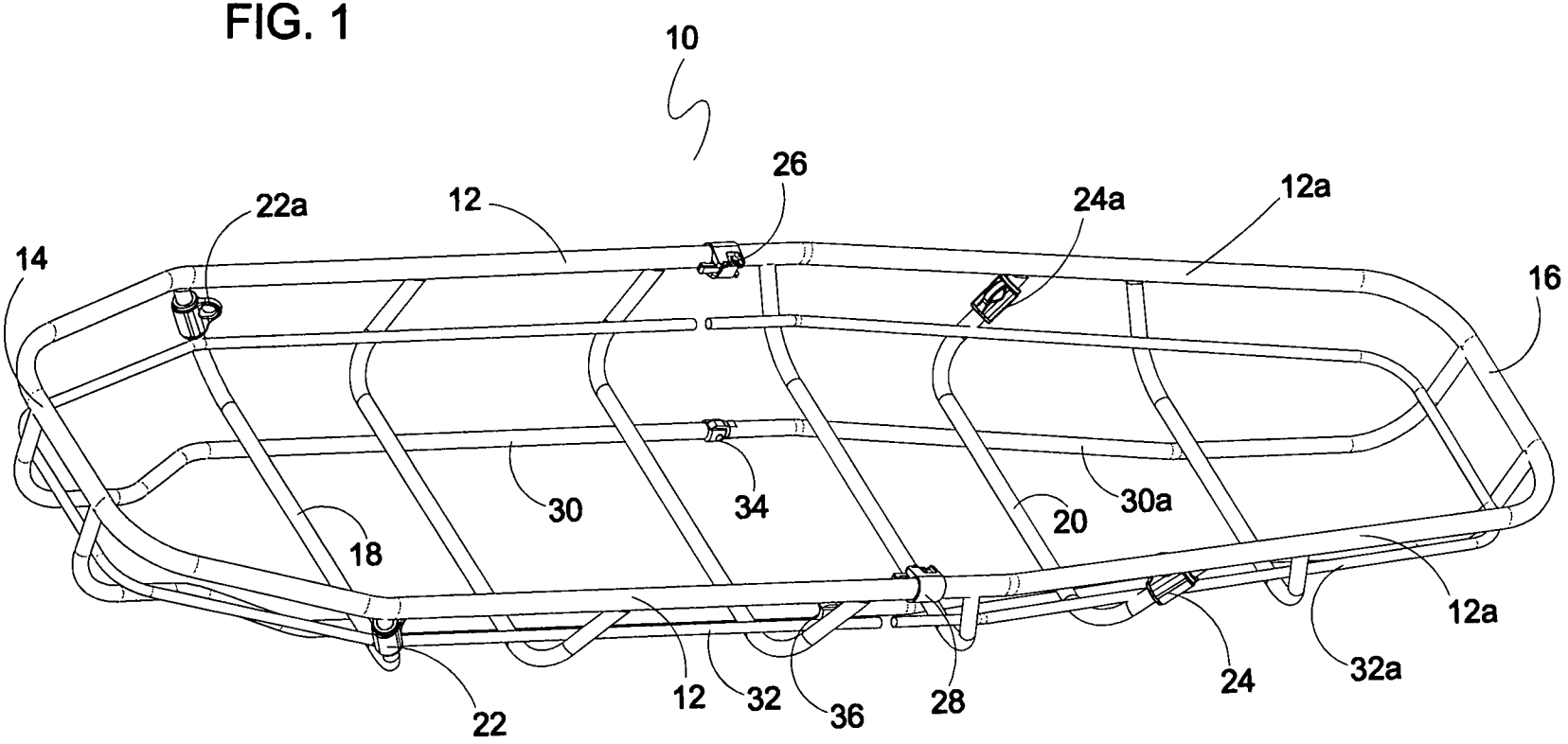
FIG. 1 is a perspective view taken from above the top and from the side of the first embodiment of the invention.

With reference to the drawing figures wherein similar characters of reference denote corresponding parts in each view, as seen in FIG. 1 rescue basket 10 includes a pair of longitudinal wraparound top rails 12 and 12*a*. Rescue basket includes a head end 14 and a foot end 16. Attached to top rails 12 and 12*a* are two transverse crossbars 18 and 20 respectively. Transverse crossbars 18 and 20 each include a pair of bridle attachment members 22, 22*a* and 24, 24*a* respectively. Top rails 12 and 12*a* include two connector couplings 26 and 28. Transverse crossbars 18 and 20 are attached to two bottom runner rails 30, 32 and 30*a*, 32*a*. Bottom runner rails 30, 32 and, 30*a*, 32*a* are connected by hinged joints 34 and 36.

Figure 2A:
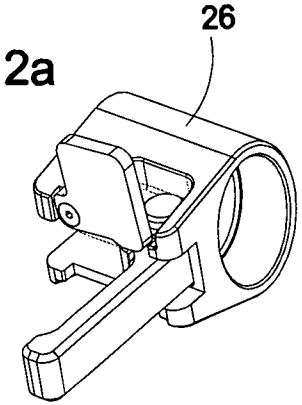
FIG. 2*a* is a perspective view taken from above the top and from the inside of the split-apart rescue basket head end female locking connector.
Figure 2B:
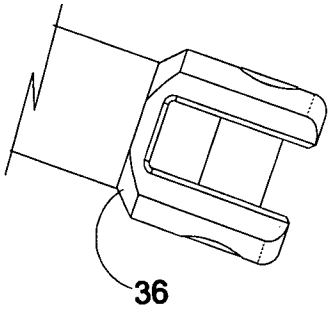
FIG. 2*b* is a top view of the split-apart rescue basket head end bottom runner rail female hinge connector.
Figure 2:
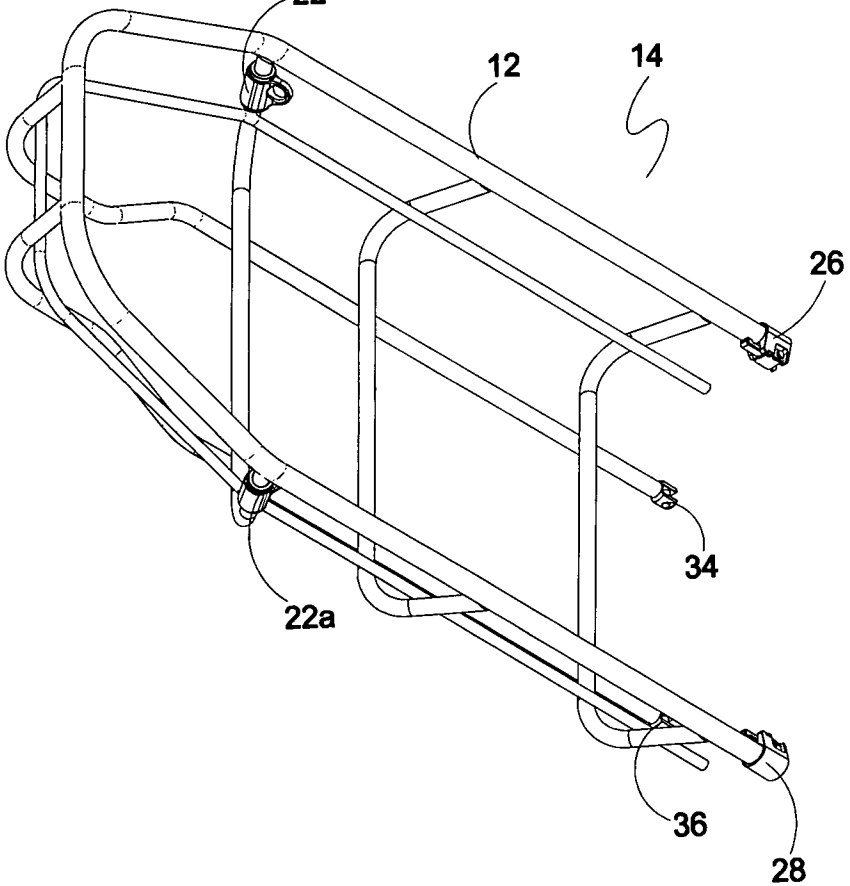
FIG. 2 is a perspective view taken from above the top and from the side of the split-apart rescue basket head end.

As seen in FIG. 2 there is a split-apart rescue basket head end 14 showing top rail attachment joint female connectors ends 26 and 28, and bottom runner rails 30, 32, and showing female hinged connectors 34 and 36. In FIG. 2*a* the female locking connector 26 is shown enlarged and separated from rescue basket head end 14. In FIG. 2*b* the female hinge connector 36 is shown, also enlarged and separated from the rescue basket head end 14.

Figure 3A:
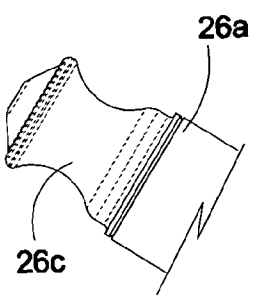
FIG. 3*a* is a top view of the split-apart rescue basket foot end female connector.
Figure 3B:
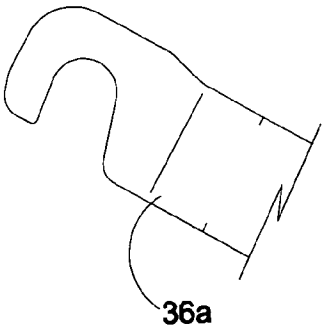
FIG. 3*b* is a side elevation view of the split-apart rescue basket foot end bottom runner rail male hinge connector.
Figure 3:
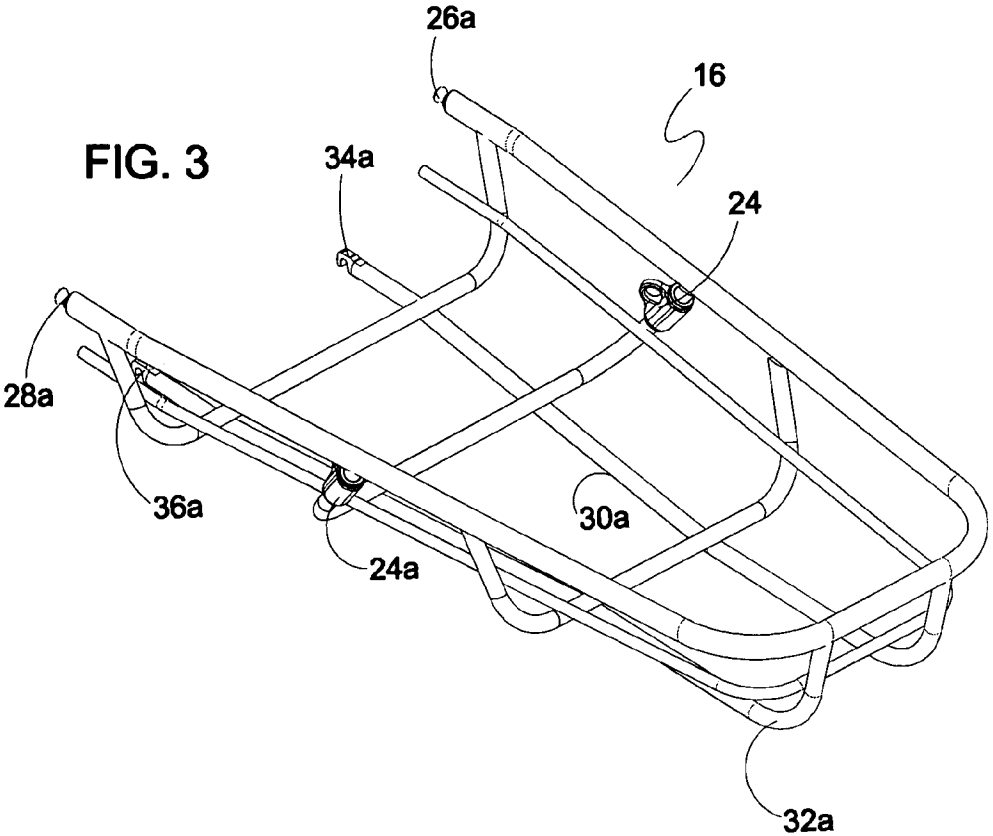
FIG. 3 is a perspective view taken from the top view of the split-apart rescue basket foot end male connector.

As seen in FIG. 3 there is a split-apart rescue basket foot end 16 showing top rail attachment joint male connector ends 26*a* and 28*a*, and bottom runner rails 30*a*, 32*a*, showing male hinged connectors 34*a* and 36*a*. In FIG. 3*a* the male locking connector 26*a* is shown enlarged and separated from the rescue basket foot end 16. In FIG. 3*b* the male hinge connector 36*a* is also shown enlarged and separated from the rescue basket foot end 16.

Figure 4B:
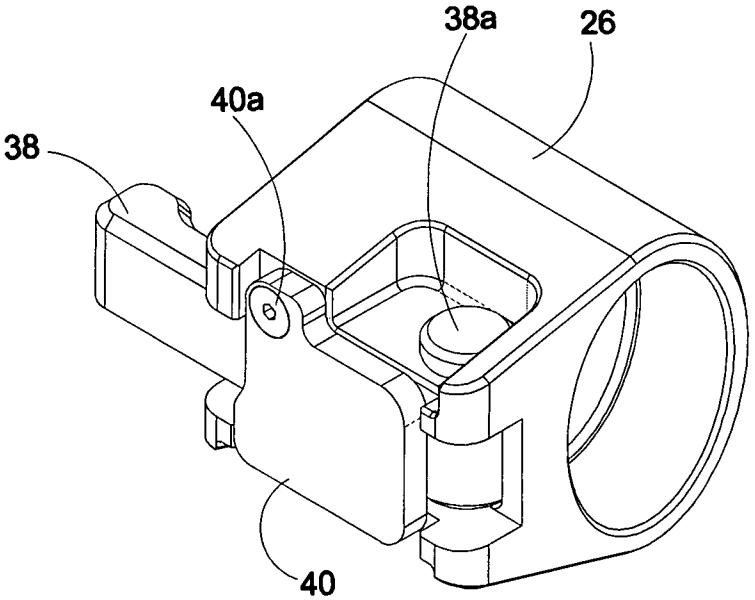
FIG. 4*b* is a perspective view taken from above the top as from the inside of the split-apart rescue basket head end female locking connector showing the lever in the latched position with the secondary safety lock in the locked position.
Figure 4A:
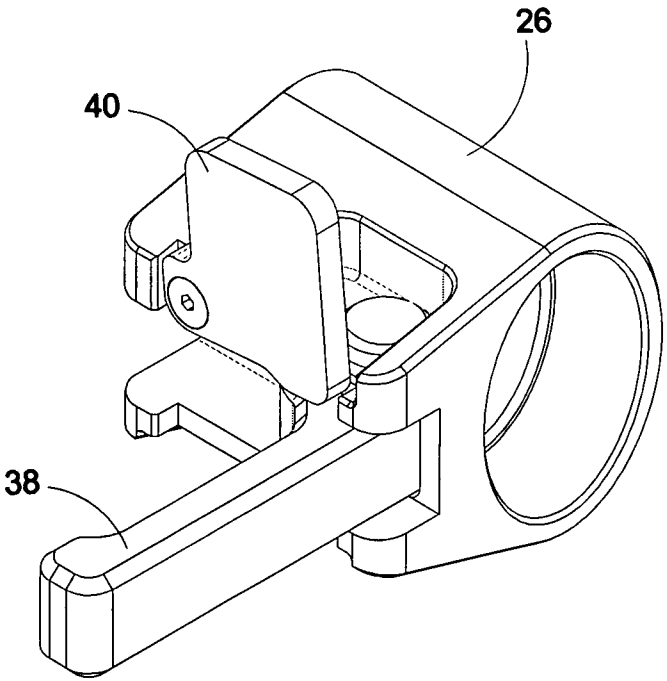
FIG. 4*a* is a perspective view taken from above the top and from the inside of the split-apart rescue basket head end female locking connector showing the lever in the unlatched position.

As seen in FIG. 4*a* the split-apart rescue basket head end female locking connector 26 is shown with the latching lever 38 in the unlatched position and safety lock 40 in the unlocked position. As seen in FIG. 4*b* the split-apart rescue basket head end female locking connector 26 is shown with the latching lever 38 in the latched position and safety lock 40 in the locked position.

Figure 5B:
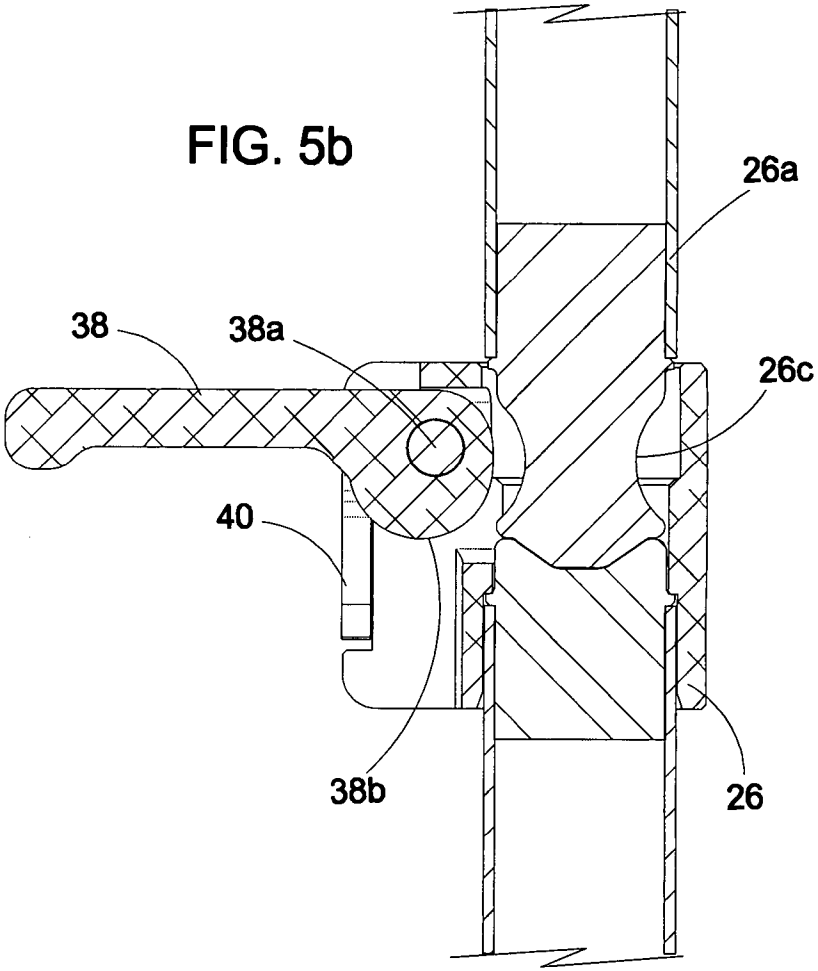
FIG. 5*b* is a sectional view taken along line A in FIG. 5*a* of the split-apart rescue basket head end female locking connector showing the lever in the unlatched position.
Figure 5A:
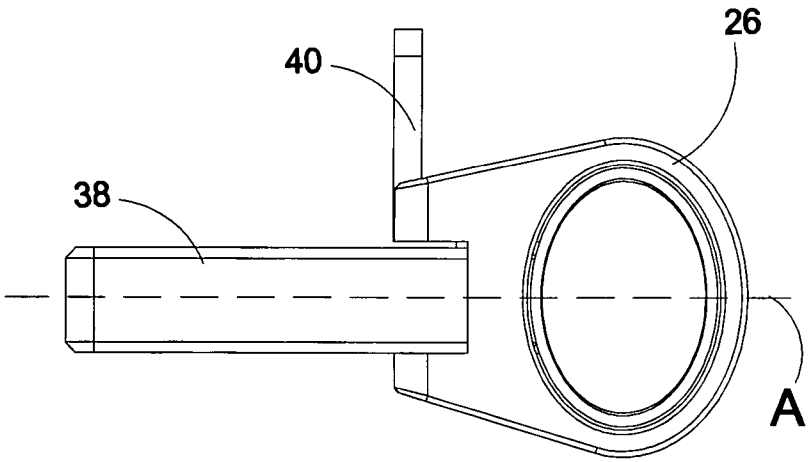
FIG. 5*a* is an end elevational view of the split-apart rescue basket head end female locking connector showing the lever in the unlatched position.

Looking from an end elevational view as seen in FIG. 5*a* the split-apart rescue basket head end female connector 26 is shown with the latching lever 38 in the unlatched position and safety lock 40 in the unlocked position. Looking from a cross-section view taken along line A in FIG. 5*a* the split-apart rescue basket head end female connector 26 is shown in the latched position with the latching lever 38 in the unlatched position and safety lock 40 in the unlocked position.

Figure 6B:
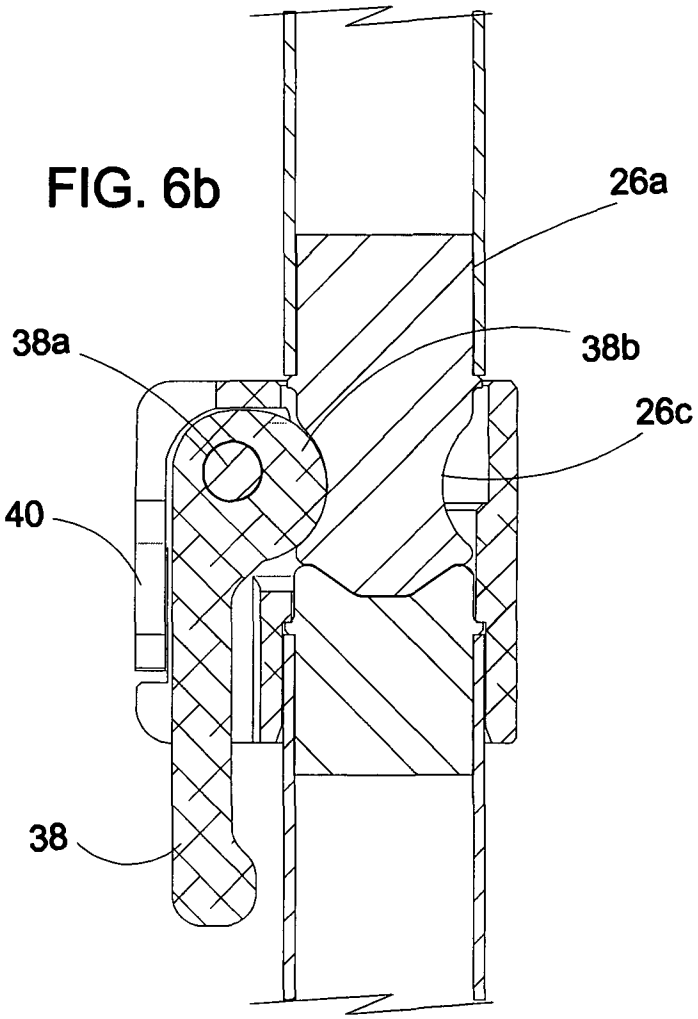
FIG. 6*b* is a sectional view taken along line B in FIG. 6*a* of the split-apart rescue basket head end female locking connector showing the lever in the latched position.
Figure 6A:
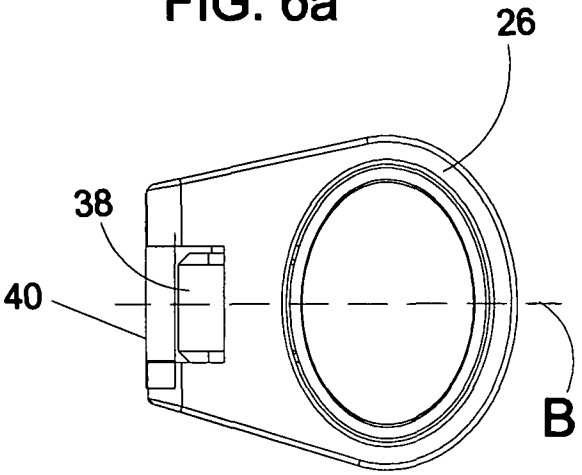
FIG. 6*a* is an end elevational view of the split-apart rescue basket head end female locking connector showing the lever in the latched position.

Looking from an end elevational view as seen in FIG. 6*a* the split-apart rescue basket head end female connector 26 is shown with the latching lever 38 in the latched position and safety lock 40 in the locked position. Looking from a sectional view taken along line A in FIG. 6*a* the split-apart rescue basket head end female connector 26 is shown in the latched position with the latching lever 38 having been pivoted on axis pin 38*a*, with latching lever cam 38*b* moving into recess 26*c* of male connector end 26*a*. Safety lock 40 has been pivoted in the locked position on pin 40*a*, which is better shown in FIG. 4*b*.

Figure 7:
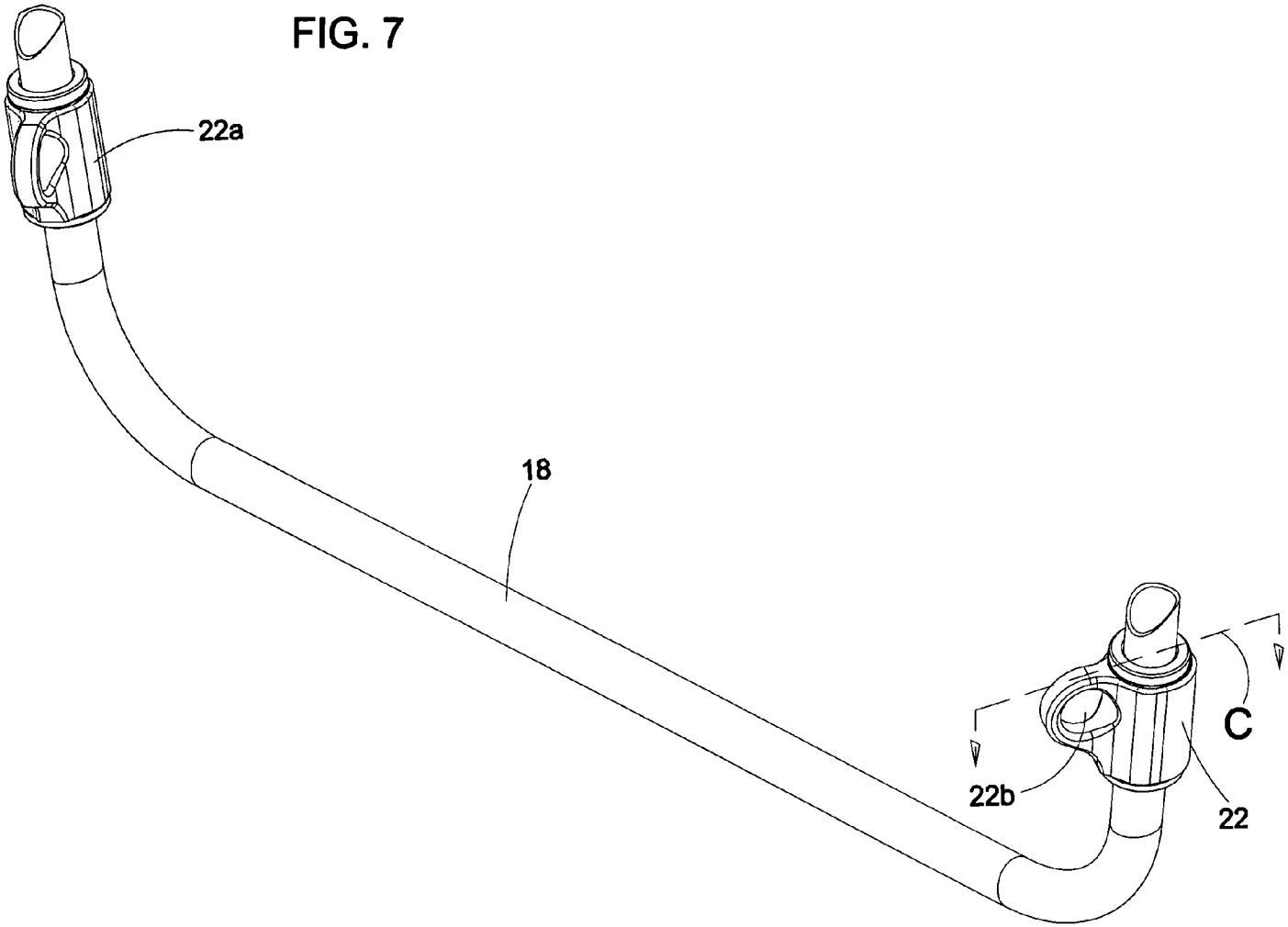
FIG. 7 is a segmental perspective view taken from above the top and from the side of the rescue basket showing one transverse crossbar with the pivotal bridle attachment member mounted thereon the transverse crossbar.

As seen in FIG. 7 the transverse crossbar 18 is shown separated from the rescue basket head end 14 with the pivotal bridle attachment member 22 and 22*a* mounted onto the upper area of the transverse crossbar 18. The bridle attachment receiving opening 22*b* is shown here.

Figure 8B:
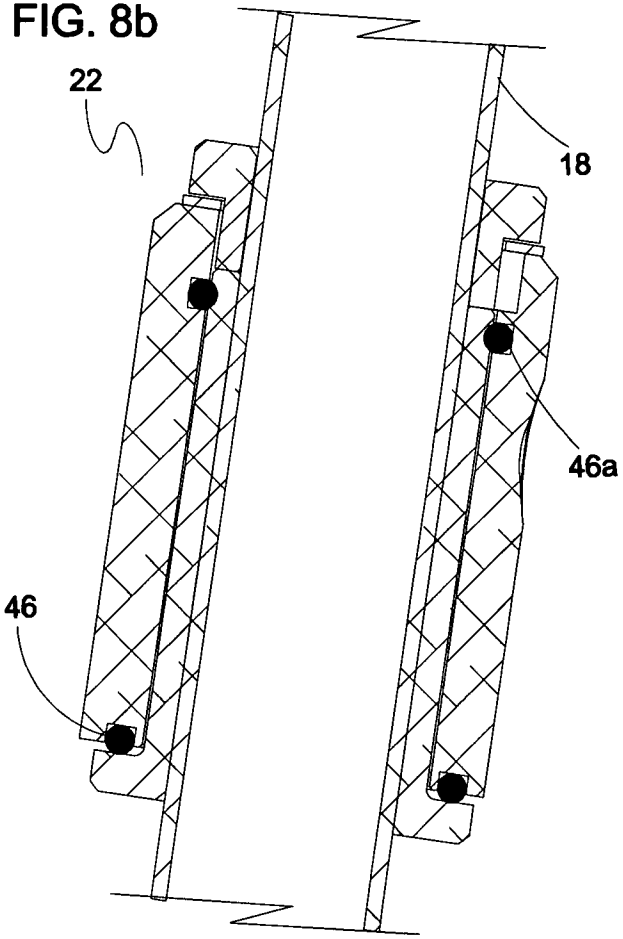
FIG. 8*b* is a sectional view taken along line D in FIG. 8*a* of the rescue basket pivotal bridle attachment member.
Figure 8A:
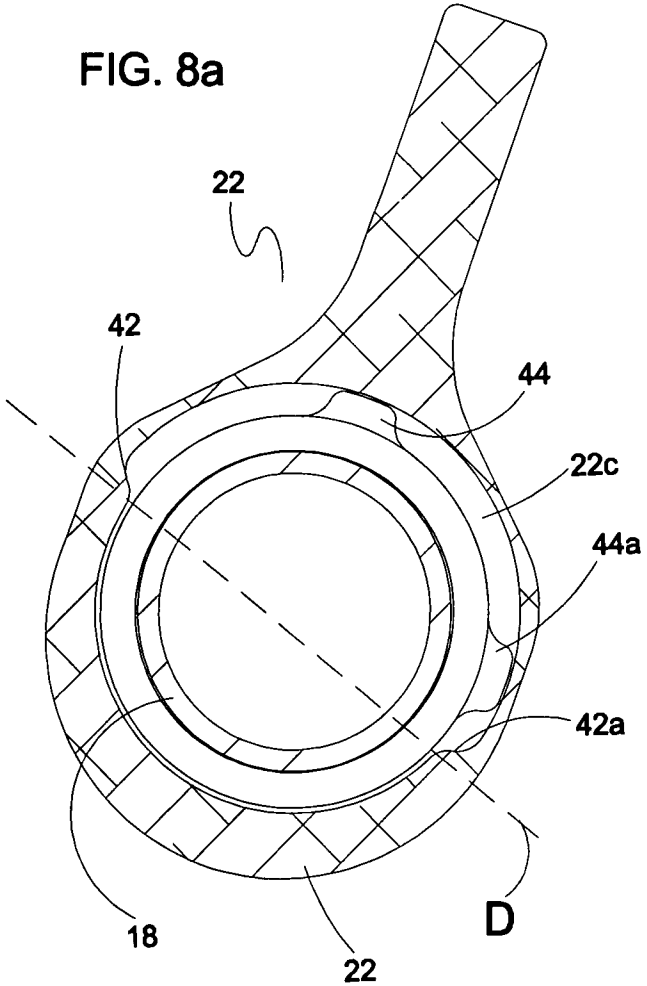
FIG. 8*a* is a sectional view taken along line C in FIG. 7 of the rescue basket pivotal bridle attachment member.

As seen in FIG. 8*a* the pivotal bridle attachment member is shown in a sectional view taken along line C of the pivotal bridle attachment member 22 in FIG. 7, where rotation limiting shoulders 42 and 42*a*, and rotation stops 44 and 44*a* can be seen within curved stop passage 22*c*. As seen in FIG. 8*b* a cross-section view taken along line D in FIG. 8*a* of the rescue basket pivotal bridle attachment member 26, shows optional O-rings 46 and 46*a*.

Figure 9:
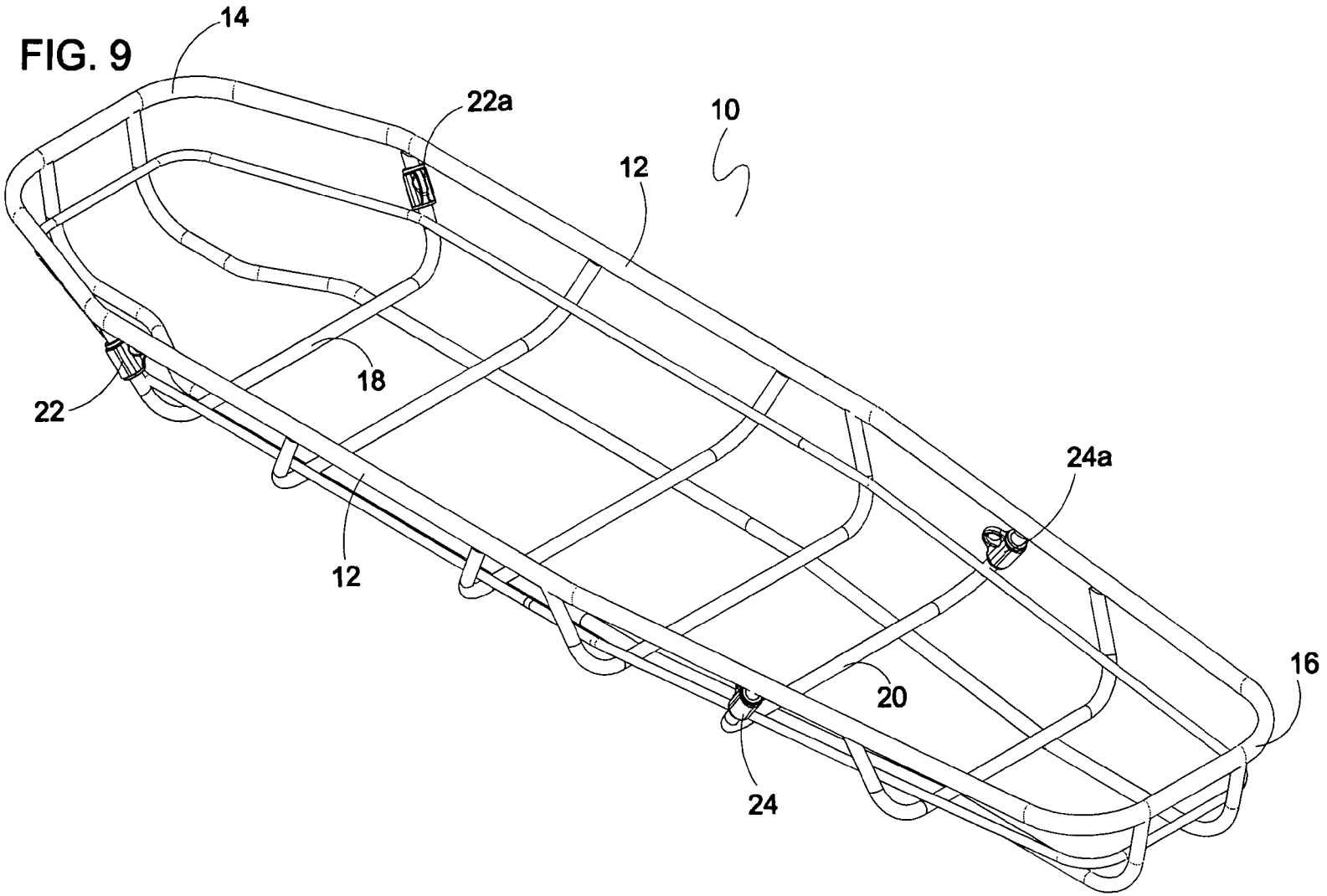
FIG. 9 is a perspective view taken from above the top and from the side of the second embodiment of the invention.

As seen in FIG. 9 the rescue basket 10 is shown as a one-piece constructed unit, which is designed mainly for lower product pricing.

The foregoing descriptions of specific embodiments of the present invention have been presented for purposes of illustration and description. They are not intended to be exhaustive or to limit the invention to the precise forms disclosed, and obviously modifications and variations are possible in light of the above teaching. The embodiments were chosen and described in order to best explain the principles of the invention and its practical application, to thereby enable others skilled in the art to best utilize the invention with various modifications as are suited to the particular use contemplated. It is intended that the scope of the invention be defined by the claims appended hereto and their equivalents.

What is claimed is:

1. A rescue basket apparatus comprising: a rescue basket including at least one top rail extending longitudinally around upper edges of a top of said rescue basket so as to define an opening into a basket cavity within said rescue basket, said rescue basket having a head end and a foot end, at least two transverse crossbars affixed to said at least one top rail so as to extend down a first side, across a bottom and extending up a second side and affixed to said at least one top rail of said rescue basket, at least two bottom runner rails running longitudinally of said rescue basket bottom, at least two pairs of bridle attachment members spaced longitudinally apart relative to said at least one top rail, each bridle attachment member has a bridle attachment receiving opening, each bridle attachment member is pivotally mounted to said transverse crossbars near and below said at least one top rail, each said bridle attachment member receiving opening extends inwardly into said rescue basket cavity, and whereby each bridle attachment member pivotal movement is confined to a partial rotation about an axis thereon said at least two transverse crossbars.

2. The rescue basket apparatus according to claim 1, wherein said at least two transverse crossbars extend obliquely down said first side, across said bottom and extending obliquely up said second side and affixed to said at least one top rail of said rescue basket.

3. The rescue basket apparatus according to claim 1, wherein said at least two transverse crossbars extend substantially at a right angle down said first side, across said bottom and extending substantially at a right angle up said second side and affixed to said at least one top rail of said rescue basket.

4. The rescue basket apparatus according to claim 1, wherein said at least two pairs of bridle attachment members include a head end pair and a foot end pair.

5. The rescue basket apparatus according to claim 4, wherein said head end pair of pivotally mounted bridle attachment members partial rotational movement is restricted to between a maximum of 180 degrees and a minimum of 160 degrees of rotation.

6. The rescue basket apparatus according to claim 4, wherein said foot end pair of pivotally mounted bridle attachment members partial rotational movement is restricted to between 10 degrees and 90 degrees of rotation.

7. The rescue basket apparatus according to claim 1, wherein said pivotally mounted bridle attachment members have at least one friction seal O-ring to seal and stiffen said rotational movement.

8. The rescue basket apparatus according to claim 1, wherein said at least one top rail comprise at least two connectable sections to form a split-apart rescue basket for compact transportation.

9. The rescue basket apparatus according to claim 8, wherein said split-apart rescue basket connectable sections are connected with at least two lever latch connectors.

10. The rescue basket apparatus according to claim 9, wherein said split-apart rescue basket top rail connectors are male and female connectors.

11. The rescue basket apparatus according to claim 10, wherein said female lever latch connectors each include a secondary safety locking device.

12. The rescue basket apparatus according to claim 8, wherein said split-apart rescue basket having said at least two bottom runner rails, wherein said at least two bottom runner rails comprise at least two connectable sections.

13. The rescue basket apparatus according to claim 12, wherein said split-apart rescue basket at least two bottom runner rails having at least two connectable sections that include at least two male and female hinged connectors.

* * * * *